US006969132B1

(12) United States Patent
Viville

(10) Patent No.: US 6,969,132 B1
(45) Date of Patent: Nov. 29, 2005

(54) FOOD DISPENSING CHEST

(75) Inventor: Bernard Viville, Veutabreu (FR)

(73) Assignee: Benoit Viville, Obaix (BE)

( * ) Notice: Subject to any disclaimer, the term of this patent is extended or adjusted under 35 U.S.C. 154(b) by 0 days.

(21) Appl. No.: 09/673,947

(22) PCT Filed: Apr. 28, 1999

(86) PCT No.: PCT/FR99/01014

§ 371 (c)(1),
(2), (4) Date: Dec. 15, 2000

(87) PCT Pub. No.: WO99/55199

PCT Pub. Date: Nov. 4, 1999

(30) Foreign Application Priority Data

Apr. 28, 1998 (FR) ..... 98 05636

(51) Int. Cl.[7] ..... A47B 57/30

(52) U.S. Cl. ..... 312/306; 312/312; 211/1.3; 211/133.3

(58) Field of Search ..... 312/236, 306, 312/305, 310, 312, 319.5, 319.7, 401, 9.17; 211/1.3, 133.1, 133.2, 133.3, 133.4, 144

(56) References Cited

U.S. PATENT DOCUMENTS

| | | | | | |
|---|---|---|---|---|---|
| 48,888 | A | * | 7/1865 | Atwater | 108/96 |
| 1,033,014 | A | * | 7/1912 | Holstein | 312/9.17 |
| 1,566,860 | A | * | 12/1925 | Hainzigianis | 312/312 X |
| 1,676,108 | A | * | 7/1928 | Novak | 312/312 X |
| 2,319,613 | A | * | 5/1943 | Lichtstern et al. | 312/240 |
| 2,447,606 | A | * | 8/1948 | Wine | 312/312 X |
| 2,463,506 | A | * | 3/1949 | Ball | 312/322 |
| 2,525,164 | A | * | 10/1950 | Ackles | 312/312 X |
| 2,563,208 | A | * | 8/1951 | Bugenhagen | 312/236 |
| 2,895,311 | A | * | 7/1959 | Spalvins | 312/312 X |
| 3,172,715 | A | * | 3/1965 | Powder | 312/306 X |
| 3,531,169 | A | * | 9/1970 | Hoffmann et al. | 312/236 |
| 3,650,591 | A | * | 3/1972 | Longmire Sr. | 312/306 X |
| 4,244,566 | A | * | 1/1981 | Molovinsky | 472/68 |
| 4,982,820 | A | * | 1/1991 | Scott | 190/16 |
| 5,391,043 | A | * | 2/1995 | Bohata et al. | 414/544 |
| 5,839,586 | A | * | 11/1998 | Smith | 312/236 X |

FOREIGN PATENT DOCUMENTS

| | | | |
|---|---|---|---|
| FR | 2562780 | * 10/1985 | |
| GB | 645071 | * 10/1950 | 312/312 |

* cited by examiner

*Primary Examiner*—James O. Hansen
(74) *Attorney, Agent, or Firm*—Barnes & Thornburg

(57) ABSTRACT

A chest (1) for distributing food, the chest being provided with a vertical mast (4) on which supports (2) are fixed. The chest has lifting means for moving said mast in vertical translation, and in addition at least some of the supports are movable in rotation about an axis which coincides with the mast.

8 Claims, 3 Drawing Sheets

FOOD DISPENSING CHEST

BACKGROUND OF THE INVENTION

The present invention relates to a chest for distributing food prepared prior to being eaten, such as cooked dishes or desserts. More specifically, the chest serves to store and present trays provided with culinary preparations; it can even be used for transporting the trays.

Such preparations are generally put onto the trays in a kitchen, and they are then transported by means of a refrigerated van before finally being unloaded and placed on tables in the premises where they are eaten, e.g. a buffet.

Firstly, it is necessary to have a refrigerated vehicle.

Secondly, unloading needs to be performed shortly before the preparations are eaten so that they are not spoilt by being stored at ambient temperature. Unfortunately, it is not always possible to know in advance the precise time at which the preparations are going to be eaten.

Thirdly, labor is required to load the van, to unload it, and to put the trays on the tables.

An object of the present invention is thus to provide a food distributing chest which considerably minimizes the above-mentioned constraints.

SUMMARY OF THE INVENTION

According to the invention, a food distributing chest is provided with a vertical mast on which supports are fixed; the chest has lifting means for moving the mast in vertical translation, and in addition at least some of its supports are movable in rotation about an axis which coincides with the mast.

Preferably, the chest is suitable for maintaining a constant temperature.

In a preferred embodiment, said mast is adjacent to one of the vertical edges of the chest.

Furthermore, the chest includes a housing provided with thermal blocks.

According to an advantageous characteristic, the lifting means are implemented on the basis of a spring.

Furthermore, the chest has a lid which, in the open position, forms two horizontal shelves.

Additionally, the supports are adjustable forks whose two tines are provided with facing grooves.

Optionally, a spacer is placed between two supports on the mast.

Furthermore, the chest is provided with a retractable guide to facilitate insertion of the supports.

Also, the chest is provided at its bottom with castors.

BRIEF DESCRIPTION OF THE DRAWINGS

The present invention is described in greater detail below in the following description of embodiments given by way of non-limiting example and with reference to the accompanying figures, in which.

DESCRIPTION OF PREFERRED EMBODIMENT

Elements that are present in more than one figure are given the same references in each figure.

Figure 1:
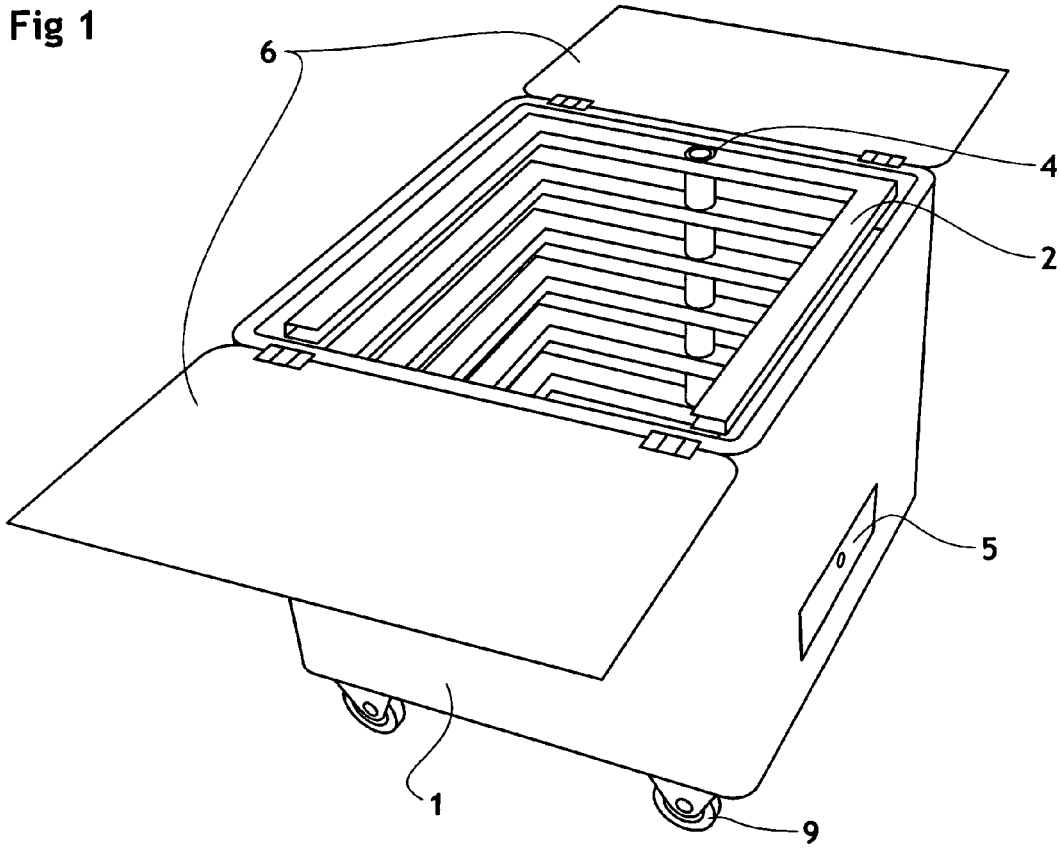
FIG. 1 is a perspective view of a chest in a first mode of use.

In FIG. 1, the chest 1 is shown in its storage or transport position except that its lid is open. It is in the form of a box having a vertical mast 4 disposed therein close to the middle of one of its side walls, the mast being provided with supports 2 and being shown in this figure in its low position.

Advantageously, the walls of the chest are lagged to maintain a constant temperature. A housing 5 such as a drawer is thus provided to receive hot or cold thermal blocks. These blocks are commonly available in the trade and are generally provided with a fluid having high specific heat, and depending on the intended use, they are previously stored in an oven or in a refrigerator so as to become a hot or a cold source. The housing in this case is located at the bottom of one of the side walls since this disposition is favorable when culinary preparations are to be kept hot.

Furthermore, in order to make the chest easier to move, it is preferably provided with castors 9 fitted to its bottom.

In a preferred embodiment, the lid of the chest 1 comprises two identical plates 6 hinged to the tops of two opposite side walls. The hinges are designed so as to come into abutment when the plates are perpendicular to the side walls, i.e. when they are substantially horizontal. Thus, the open lid forms two shelves located on opposite sides of the chest.

Figure 2:
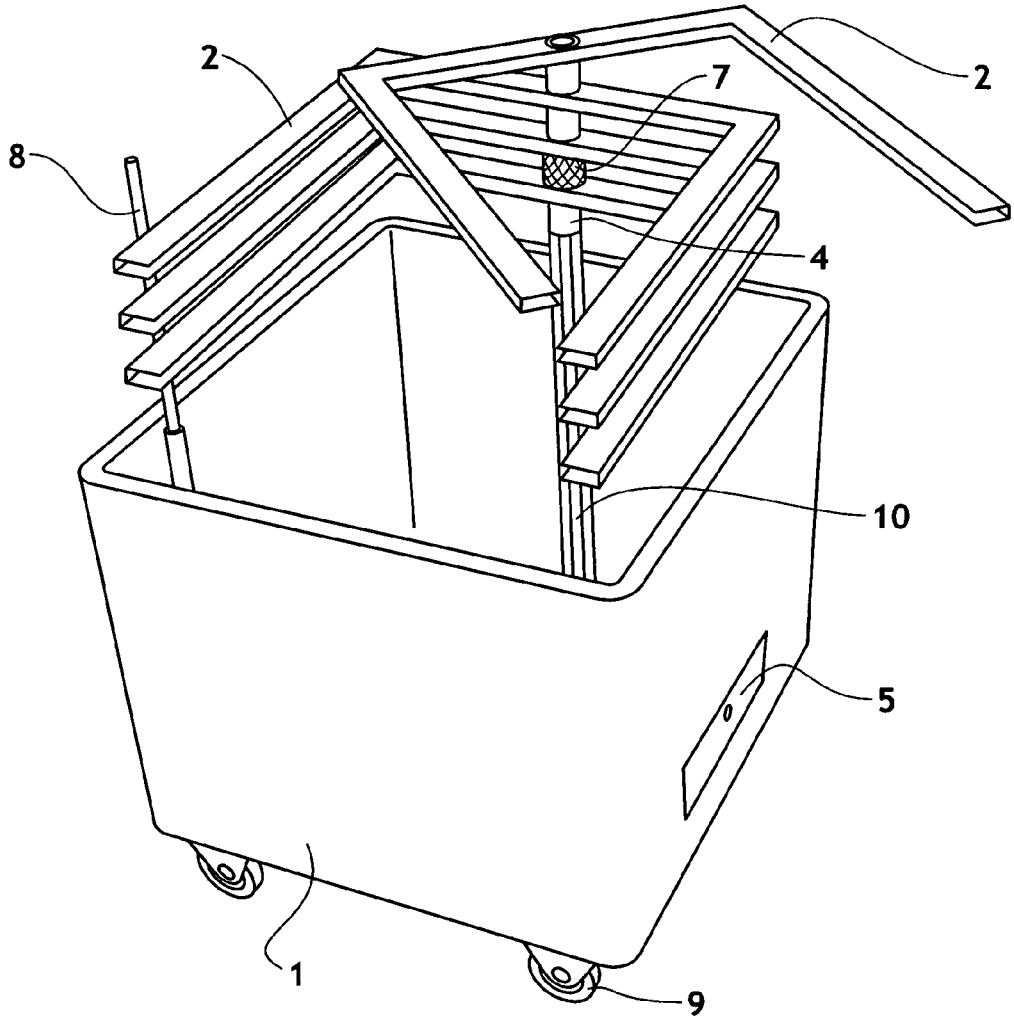
FIG. 2 is a perspective view of the chest in a second mode of use.

In FIG. 2, the chest 1 is shown in its in-service position, without its lid. The mast 4 slides on a guide column(not shown) and is shown here in its high position. Lifting means 10 serve to move the mast along its axis from its low position in abutment against the bottom of the chest, to its high position where the supports are clear of the chest 1.

The mast 4 can be displaced manually. It is pulled vertically into its high position and it is held in this position by locking means. To return it to the low position, it suffices to release the locking means and allow the mast to move back down to the bottom of the chest.

The mast 4 could also be motor-driven, e.g. by means of a worm screw.

It will readily be understood that the mast can be moved by any known means, be they electrical, pneumatic, or hydraulic. It is even possible to envisage using a mechanical system with counterweights if manual actuation is preferred.

Nevertheless, according to a preferred characteristic, the mast 4 is actuated by means of a spring, e.g. a gas spring. Under such circumstances, the mast is easy to handle and the chest is entirely self-contained since it does not require an energy source such as an electric battery.

The supports 2 in this case are in the form of forks engaged on the mast 1. To this end, a circular orifice is provided in the center of the base of each support. At least some of the supports can pivot about the axis of the mast. It is thus possible to offset them angularly so as to form a helix, with the left tine of one support coinciding approximately with the right tine of the support situated immediately below it. Thus, no support is directly masked by the other supports overlying it.

A retractable guide 8 such as a telescopic rod is preferably provided to facilitate storing the mast 1 in its low position. Before moving the mast, all of the supports are brought into abutment against the guide 8 which is disposed against a side wall. As a result, the supports do not strike the top of the chest when the mast is lowered.

Furthermore, if the gap between two supports 2 is too small, then a spacer 7 can be placed between the two supports.

Figure 3:
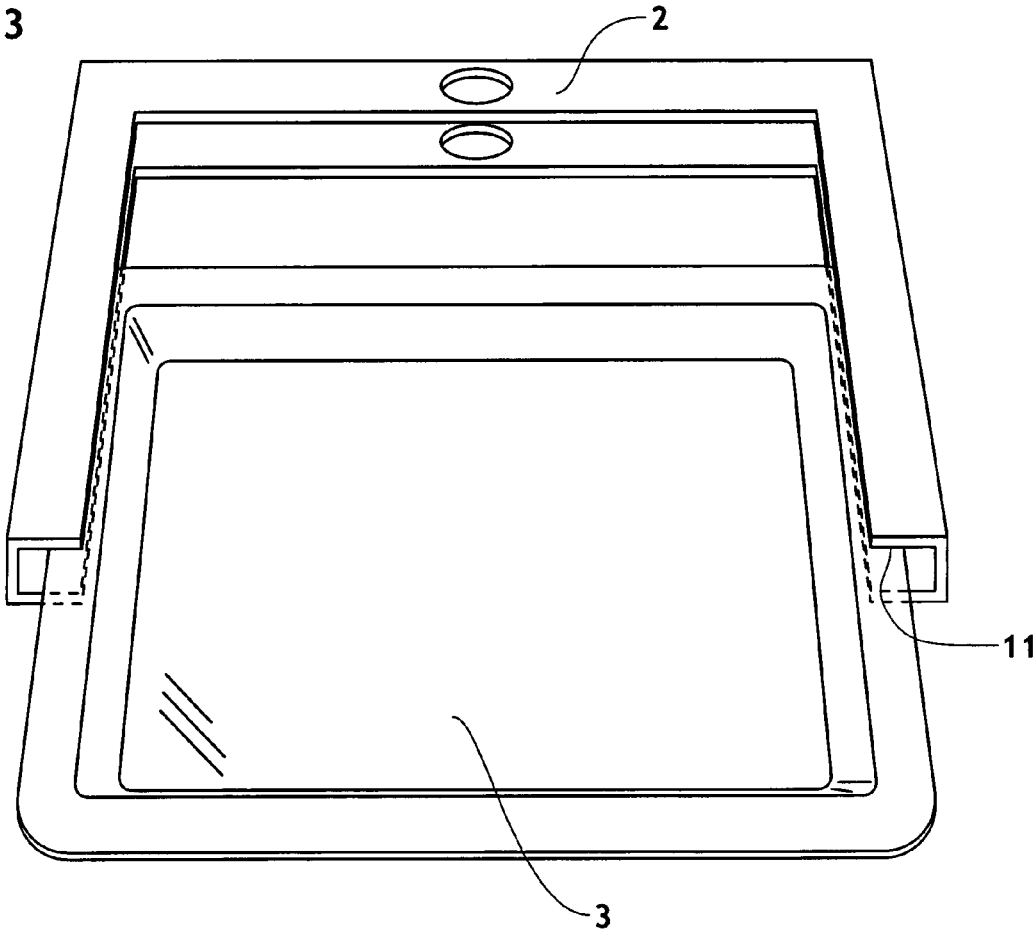
FIG. 3 shows an embodiment of the supports.

With reference to FIG. 3, a preferred support, i.e. a fork, comprises two tines provided with facing grooves 11. A tray 3 carrying a culinary preparation is inserted in the grooves

11 which also serve to hold it. In addition, the forks are adjustable so that they can accommodate trays of different sizes.

So far, the mas 4 has been shown in the vicinity of the middle of one of the side walls of the chest 1. Depending on the shape of the supports and on the type of presentation desired for the trays, it can be more advantageous to arrange the mast in the vicinity of one of the vertical edges of the chest.

The embodiments of the chest given above are given purely by way of example and the person skilled in the art will understand that the invention can be implemented in many different ways, merely by replacing some means by equivalent means.

I claim:

1. A moveable chest for distributing and displaying food, the chest being provided with a vertical mast on which supports are fixed, the mast having a longitudinal axis and the supports including adjustable forks having two tines provided with facing grooves, the chest having lifting means in the chest for moving the mast in vertical translation, and in which at least some of said supports are movable in rotation about an axis which coincides with the longitudinal axis of said mast.

2. The chest according to claim 1, suitable for maintaining a constant temperature.

3. The chest according to claim 1, in which said mast is adjacent to one of its vertical edges.

4. The chest according to claim 1, including a housing for thermal blocks.

5. The chest according to claim 1, including a lid which, in an open position, forms two horizontal shelves.

6. The chest according to claim 1, including a spacer located between two supports on said mast.

7. The chest according to claim 1, including a retractable guide for facilitating insertion of said supports.

8. The chest according to claim 1, including castors on the bottom of the chest.

* * * * *